US008020625B2

(12) United States Patent
Ring et al.

(10) Patent No.: US 8,020,625 B2
(45) Date of Patent: Sep. 20, 2011

(54) MONOBORE CONSTRUCTION WITH DUAL EXPANDERS

(75) Inventors: Lev Ring, Houston, TX (US); Carel W. I. Hoyer, Calgary (CA)

(73) Assignee: Weatherford/Lamb, Inc., Houston, TX (US)

( * ) Notice: Subject to any disclaimer, the term of this patent is extended or adjusted under 35 U.S.C. 154(b) by 57 days.

(21) Appl. No.: 12/428,839

(22) Filed: Apr. 23, 2009

(65) Prior Publication Data

US 2009/0266560 A1 Oct. 29, 2009

Related U.S. Application Data

(60) Provisional application No. 61/047,387, filed on Apr. 23, 2008.

(51) Int. Cl.
*E21B 43/10* (2006.01)

(52) U.S. Cl. ..... 166/380; 166/207

(58) Field of Classification Search ..... 166/206, 166/207, 380, 384
See application file for complete search history.

(56) References Cited

U.S. PATENT DOCUMENTS

| | | | | |
|---|---|---|---|---|
| 1,981,525 | A * | 11/1934 | Price | 166/381 |
| 2,796,134 | A | 6/1957 | Binkley | |
| 4,483,399 | A | 11/1984 | Colgate | |
| 4,754,781 | A | 7/1988 | Jan de Putter | |
| 5,271,472 | A | 12/1993 | Leturno | |
| 5,337,823 | A | 8/1994 | Nobileau | |
| 5,794,702 | A | 8/1998 | Nobileau | |
| 6,070,671 | A | 6/2000 | Cumming et al. | |
| 6,135,208 | A | 10/2000 | Gano et al. | |
| 6,158,514 | A | 12/2000 | Gano et al. | |
| 6,457,532 | B1 | 10/2002 | Simpson | |
| 6,725,917 | B2 | 4/2004 | Metcalfe | |
| 6,854,522 | B2 | 2/2005 | Brezinski et al. | |
| 6,860,329 | B1 | 3/2005 | Oosterling | |
| 6,883,611 | B2 | 4/2005 | Smith et al. | |
| 6,942,029 | B2 | 9/2005 | Simpson | |
| 6,966,369 | B2 | 11/2005 | Harrall et al. | |
| 7,004,264 | B2 | 2/2006 | Simpson et al. | |
| 7,007,760 | B2 | 3/2006 | Lohbeck | |
| 7,048,065 | B2 * | 5/2006 | Badrak et al. | 166/382 |
| 7,066,284 | B2 | 6/2006 | Wylie et al. | |
| 7,070,001 | B2 | 7/2006 | Whanger et al. | |
| 7,073,599 | B2 | 7/2006 | Smith | |

(Continued)

FOREIGN PATENT DOCUMENTS

CA 2 356 184 6/2000

(Continued)

OTHER PUBLICATIONS

GB Search Report for Application No. 09251151.8-2315 / 2119867 dated Nov. 13, 2009.

(Continued)

*Primary Examiner* — Daniel P Stephenson
(74) *Attorney, Agent, or Firm* — Patterson & Sheridan, LLP

(57) ABSTRACT

A method and apparatus of expanding tubing. The method may include expanding a first portion of an expandable tubing into contact with a surrounding tubing using an upper expander; expanding a second portion of the expandable tubing that extends beyond the surrounding tubing using a lower expander; and further expanding the first portion of the expandable tubing using the lower expander, thereby expanding the surrounding tubing. The apparatus may include a fluted expander coupled to a first end of the expandable tubing; and a collapsible cone disposed inside the expandable tubing.

30 Claims, 6 Drawing Sheets

U.S. PATENT DOCUMENTS

| | | | | |
|---|---|---|---|---|
| 7,077,210 | B2 | 7/2006 | MacKay et al. | |
| 7,090,022 | B2 | 8/2006 | Smith et al. | |
| 7,090,025 | B2 | 8/2006 | Haugen et al. | |
| 7,100,685 | B2 | 9/2006 | Cook et al. | |
| 7,117,940 | B2 | 10/2006 | Campo | |
| 7,117,957 | B2 | 10/2006 | Metcalfe et al. | |
| 7,121,351 | B2 * | 10/2006 | Luke et al. | 166/382 |
| 7,146,702 | B2 | 12/2006 | Cook et al. | |
| 7,152,684 | B2 | 12/2006 | Harrall et al. | |
| 7,156,179 | B2 | 1/2007 | Harrall et al. | |
| 7,159,666 | B2 | 1/2007 | Nobileau | |
| 7,172,019 | B2 * | 2/2007 | Cook et al. | 166/207 |
| 7,172,024 | B2 * | 2/2007 | Cook et al. | 166/380 |
| 7,174,764 | B2 | 2/2007 | Oosterling et al. | |
| 7,178,601 | B2 | 2/2007 | Burge | |
| 7,201,223 | B2 | 4/2007 | Cook et al. | |
| 7,204,007 | B2 | 4/2007 | Cook et al. | |
| 7,219,746 | B2 | 5/2007 | Nobileau | |
| 7,225,523 | B2 | 6/2007 | Metcalfe | |
| 7,234,531 | B2 | 6/2007 | Kendziora et al. | |
| 7,255,177 | B2 | 8/2007 | Duggan et al. | |
| 7,287,603 | B2 | 10/2007 | Hay et al. | |
| 7,303,023 | B2 | 12/2007 | Harrall et al. | |
| 7,308,755 | B2 | 12/2007 | Cook et al. | |
| 7,325,602 | B2 | 2/2008 | Cook et al. | |
| 7,350,563 | B2 | 4/2008 | Waddell et al. | |
| 7,350,584 | B2 | 4/2008 | Simpson et al. | |
| 7,363,690 | B2 | 4/2008 | Cook et al. | |
| 7,363,691 | B2 | 4/2008 | Cook et al. | |
| 7,367,389 | B2 * | 5/2008 | Duggan et al. | 166/207 |
| 7,373,990 | B2 | 5/2008 | Harrall et al. | |
| 7,377,310 | B2 * | 5/2008 | Benzie et al. | 166/72 |
| 7,383,889 | B2 | 6/2008 | Ring et al. | |
| 7,395,857 | B2 * | 7/2008 | Hillis | 166/207 |
| 7,410,001 | B2 | 8/2008 | Harrall et al. | |
| 7,419,193 | B2 | 9/2008 | Simpson | |
| 7,451,811 | B2 | 11/2008 | Lohbeck et al. | |
| 7,475,723 | B2 | 1/2009 | Ring et al. | |
| 7,478,651 | B2 | 1/2009 | Simpson | |
| 7,490,676 | B2 | 2/2009 | Nobileau | |
| 7,497,255 | B2 | 3/2009 | Filippov et al. | |
| 7,513,313 | B2 | 4/2009 | Watson et al. | |
| 7,516,790 | B2 | 4/2009 | Cook et al. | |
| 7,543,639 | B2 | 6/2009 | Emerson | |
| 7,591,320 | B2 | 9/2009 | Phipps et al. | |
| 7,607,486 | B2 | 10/2009 | Farquhar et al. | |
| 7,681,648 | B2 | 3/2010 | Ring | |
| 7,686,076 | B2 | 3/2010 | York et al. | |
| 7,699,112 | B2 | 4/2010 | Galloway | |
| 7,730,955 | B2 | 6/2010 | Farquhar et al. | |
| 7,775,290 | B2 | 8/2010 | Brisco et al. | |
| 7,798,223 | B2 | 9/2010 | Duggan et al. | |
| 7,798,225 | B2 | 9/2010 | Giroux et al. | |
| 2003/0183395 | A1 * | 10/2003 | Jones | 166/380 |
| 2004/0216891 | A1 * | 11/2004 | Maguire | 166/380 |
| 2004/0238181 | A1 * | 12/2004 | Cook et al. | 166/378 |
| 2005/0045342 | A1 * | 3/2005 | Luke et al. | 166/384 |
| 2005/0217866 | A1 | 10/2005 | Watson et al. | |
| 2006/0000617 | A1 * | 1/2006 | Harrall et al. | 166/380 |
| 2006/0052936 | A1 * | 3/2006 | Duggan et al. | 702/6 |
| 2006/0054330 | A1 | 3/2006 | Ring et al. | |
| 2006/0124295 | A1 * | 6/2006 | Maguire | 166/207 |
| 2007/0056743 | A1 * | 3/2007 | Costa | 166/380 |
| 2008/0128126 | A1 | 6/2008 | Dagenais et al. | |
| 2010/0193199 | A1 * | 8/2010 | Lohbeck | 166/384 |

FOREIGN PATENT DOCUMENTS

| | | |
|---|---|---|
| CA | 2 453 400 | 1/2003 |
| CA | 2 471 336 | 7/2003 |
| EP | 1 582 274 | 10/2005 |
| EP | 1 717 411 | 11/2006 |
| GB | 2 401 127 | 3/2004 |
| GB | 2 410 759 | 8/2005 |
| GB | 2412394 | 9/2005 |
| GB | 2 403 749 | 12/2005 |
| GB | 2 433 080 | 6/2007 |
| GB | 2 433 278 | 6/2007 |
| GB | 2 428 721 | 7/2007 |
| WO | WO 99/04135 | 1/1999 |
| WO | WO 99/35368 | 7/1999 |
| WO | WO 02/086286 | 10/2002 |
| WO | WO 2004/079150 | 9/2004 |
| WO | WO 2009/074243 | 6/2009 |

OTHER PUBLICATIONS

EP Partial European Search Report for EP Application No. 09 25 1151 dated Aug. 28, 2009.

Canadian Office Action for Application No. 2,663,723 dated Jan. 11, 1011.

* cited by examiner

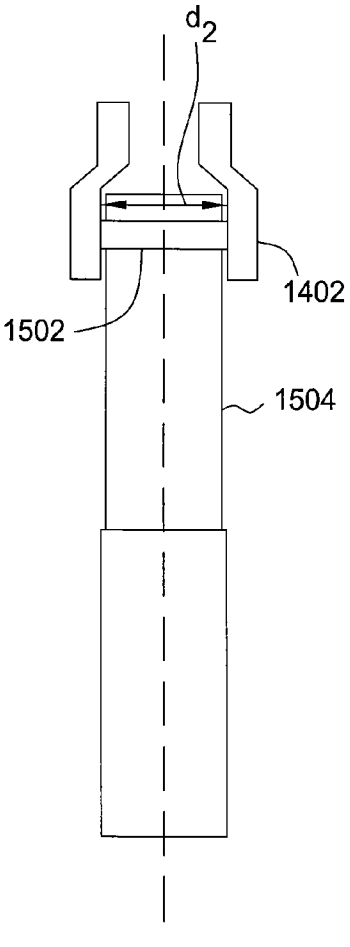
FIG. 14
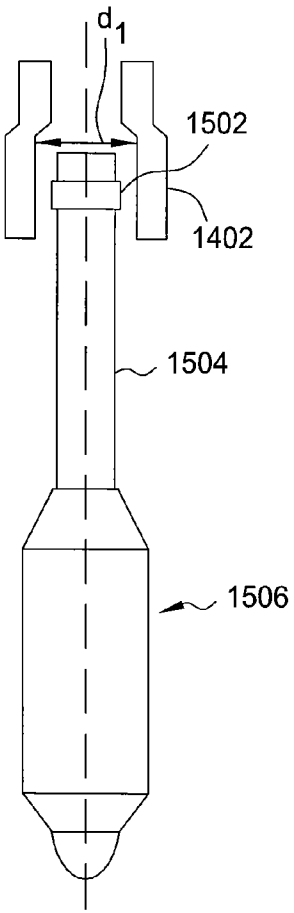
FIG. 15
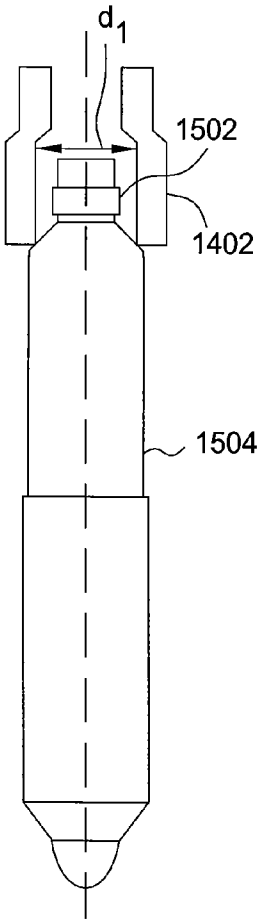
FIG. 16
FIG. 17

MONOBORE CONSTRUCTION WITH DUAL EXPANDERS

CROSS-REFERENCE TO RELATED APPLICATIONS

This application claims benefit of U.S. Provisional Patent Application Ser. No. 61/047,387, filed Apr. 23, 2008, which is herein incorporated by reference in its entirety.

BACKGROUND OF THE INVENTION

1. Field of the Invention

Embodiments of the invention generally relate to expanding tubing in a borehole.

2. Description of the Related Art

Methods and apparatus utilized in the oil and gas industry enable placing tubular strings in a borehole and then expanding the circumference of the strings in order to increase a fluid path through the tubing and in some cases to line the walls of the borehole. Some of the advantages of expanding tubing in a borehole include relative ease and lower expense of handling smaller diameter tubing and ability to mitigate or eliminate formation of a restriction caused by the tubing thereby enabling techniques that may create a monobore well. However, prior expansion techniques may not be possible or desirable in some applications.

Therefore, there exists a need for improved methods and apparatus for expanding tubing.

SUMMARY OF THE INVENTION

In one embodiment, a method of installing expandable tubing in a borehole comprises expanding a first portion of the expandable tubing into engagement with a surrounding tubing using an upper expander. The method may further include expanding a second portion of the expandable tubing using a lower expander, wherein the second portion extends beyond the surrounding tubing. The method may further include further expanding the first portion of the expandable tubing using the lower expander, wherein expanding the first portion also expands the surrounding tubing.

In one embodiment, a method of installing tubular liners in a borehole comprises running a first tubing string into the borehole, wherein the first tubing string as run into the borehole includes a first section that has an inner diameter greater than an inner diameter of a second section. The method may further include running a second tubing string into the borehole, wherein an upper portion of the second tubing string overlaps the first section of the first tubing string. The method may further include expanding the upper portion of the second tubing string into contact with the first section of the first tubing string, wherein the expanding further enlarges the inner diameter of the first section of the first tubing string.

In one embodiment, a system for installing expandable tubing in a borehole comprises an expandable tubular; a mandrel releasably coupled to a first end of the expandable tubular; a fluted expander coupled to the mandrel and disposed above the first end of the expandable tubular; and a collapsible cone coupled to the mandrel and disposed inside the expandable tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 14 illustrates expandable tubing run into a partially enlarged inner diameter shoe.

FIG. 15 shows expanding a launcher of the expandable tubing positioned to overlap the enlarged inner diameter shoe.

FIG. 16 illustrates expanding the expandable tubing between the launcher and the enlarged inner diameter shoe.

FIG. 17 shows further expansion of the partially enlarged inner diameter shoe.

DETAILED DESCRIPTION

Figure 1:
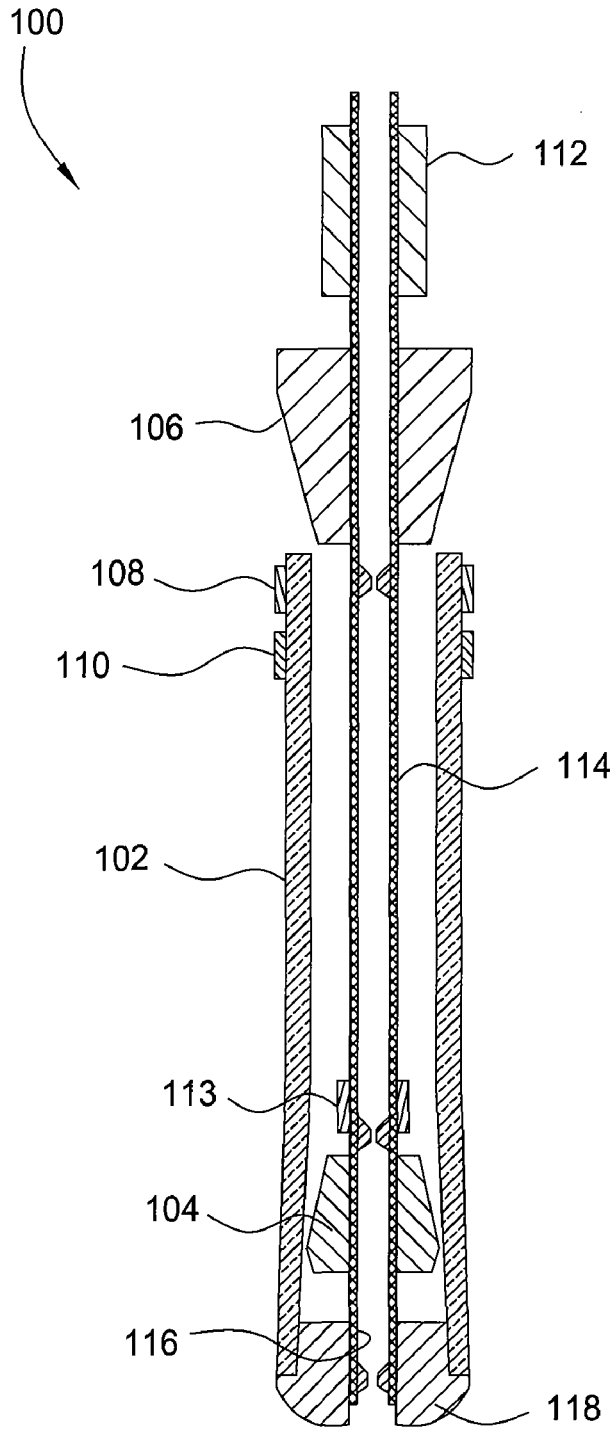
FIG. 1 illustrates a sectional view of an expansion system in a run-in position, according to embodiments of the invention.

FIG. 1 illustrates a sectional view of an expansion system 100 in a run-in position. The expansion system 100 includes a string of expandable tubing 102 coupled to a work string 114 upon which first and second expanders 104, 106 are disposed. For some embodiments, a sealing band 108 and/or an anchor 110 that is separate or integral with the sealing band 108 surround an outer surface of the expandable tubing 102 at a first end of the expandable tubing 102 proximate the second expander 106. An actuation mechanism 112 operates the second expander 106 to expand the expandable tubing 102 independent from movement of the first expander 104 through the expandable tubing 102. A first expander actuator 113 changes positions of the first expander 104. The work string 114 couples to a second end of the expandable tubing 102 through a releasable connection 116 such as a threaded arrangement. A guide nose or cement shoe 118 may form the second end of the expandable tubing 102 and facilitate insertion of the expandable tubing 102 into the borehole.

In some embodiments, a two position apparatus forms the first expander 104 and provides a first position in which the first expander 104 fits within the expandable tubing 102 prior to being expanded and a cone shaped second position with a larger outer diameter than in the first position. The cone shaped second position may define a circumferentially continuous conical shape. For example, U.S. Pat. No. 7,121,351, which is herein incorporated by reference, describes an exemplary apparatus suitable for the first expander 104 and corresponding operational details that may be employed with embodiments described herein. The system 100 may utilize other collapsible type cone arrangements for the first expander 104.

Figure 2:
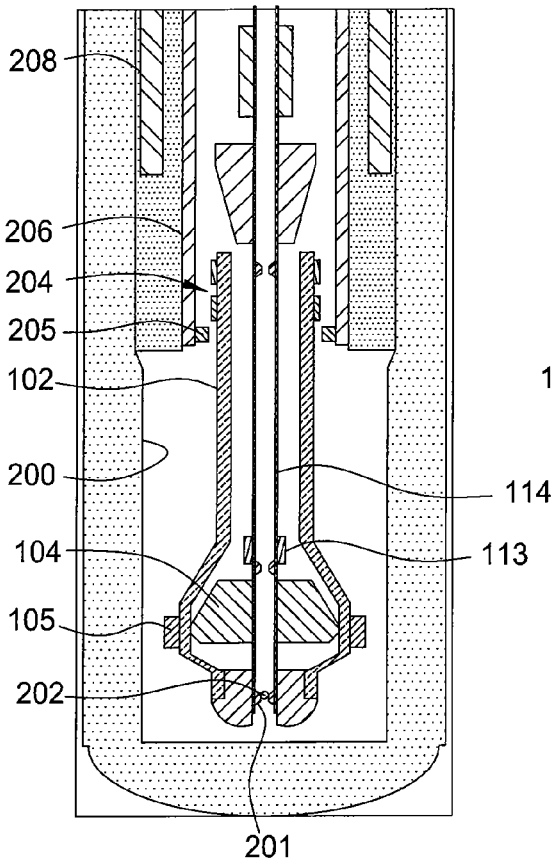
FIG. 2 shows a sectional view of the expansion system disposed in a borehole and after activating a first expander from a first position to a second position defining a larger outer diameter than in the first position, according to embodiments of the invention.

FIG. 2 shows the expansion system 100 disposed in a borehole 200 after activating the first expander 104 from the first position to the second position with the actuator 113. In operation, the work string 114 is closed, for example, by actuating a valve 201, by dropping an object such as a first ball 202 or by any other suitable mechanism/device. Pressurization of the work string 114 thereafter moves the first expander 104 to the second position. Release of the ball 202 then reestablishes a flow path through the work string 114.

Locating the expandable tubing 102 in the borehole 200 places an overlapping section 204 of the expandable tubing 102 within existing tubing 206. The existing tubing 206 may require further expansion at the overlapping section 204 of the expandable tubing 102 that is disposed inside the existing tubing 206. In order to prevent the creation of a restriction (i.e., enable monobore construction), some applications require an end of the existing tubing 206 to be expanded from about 20%-50% (change in inner diameter (ID)/pre-expanded ID*100) in order to receive the expandable tubing 102.

Achieving these expansion ratios require significant force if expanded in a single operation. While an oversize shoe can mitigate these expansion ratios, clearance in casing 208 may not permit running of the oversized shoe at an end of the existing tubing 206 into which the expandable tubing 102 is received. Reducing wall thickness of the existing tubing 206 at the overlapping section 204 to form the oversized shoe fails to provide a viable option when desired to maintain required collapse strength criteria. Simultaneous expansion of overlapped tubing further increases forces needed to perform expansion.

Practical limits exist with respect to such expansion forces when internal fluid pressure is used to drive an expansion cone since the internal fluid pressure must remain smaller than internal yield pressure. Top-down expansion systems often utilize jacks to force an expansion cone through tubing, especially when weight cannot be added to the running string, such as in horizontal bores. However, practical considerations of jacking tool construction and handling on a drilling rig often result in limitations. For example, the stroke length of the jack may be reduced as a result of the necessary construction to enable higher expansion forces. The limited stroke length of the jack that must be reset after each stroke makes expansion time consuming and reduces tool reliability when desired to expand long lengths. Further, the expansion forces can exceed tensile and compression strength of connections between tubular joints. With expansion that is only bottom-up, length of overlap must account for axial shrinkage of the tubing being expanded such that multiple joints and hence connections exist in the overlap, where such relatively higher expansion forces may be required.

In some embodiments, a single joint of the expandable tubing 102 encompasses all of the overlapping section 204 such that there are no connections disposed in the overlapping section 204. The expandable tubing 102 may extend less than 6 or 3 meters into the existing tubing 206 once located. An optional location marker or profile 205 within the existing tubing 206 may facilitate proper placement of the expandable tubing 102. After being located, the overlapping section 204 of the expandable tubing 102 remains axially stationary with respect to the existing tubing 206 as any axially shrinkage of the expandable tubing 102 during expansion results in lift-off or further separation of the expandable tubing 102 from a bottom of the borehole 200. For some embodiments, a second end of the expandable tubing 102 distal to the overlapping section 204 of the expandable tubing 102 is fixed in the borehole 200 so that the expandable tubing 102 does not recede during expansion. Such fixing of the second end for "fixed-fixed" expansion may occur via hydraulic expansion of the expandable tubing 102, such as when a garage is created for the first expander 104. An outer surface of the expandable tubing 102 may include an optional corresponding anchor 105 at the second end of the expandable tubing 102 in order to facilitate gripping contact of the expandable tubing 102 against the borehole 200.

Figure 3:
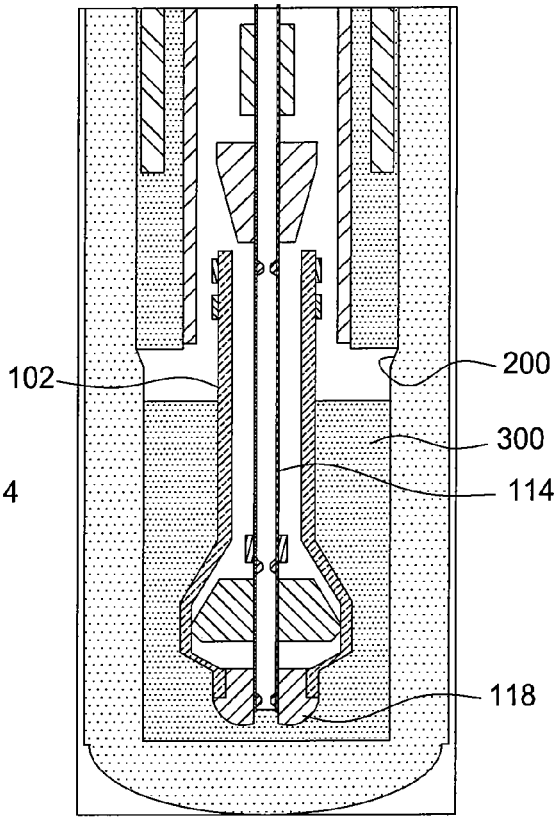
FIG. 3 illustrates introducing a fill material into an annular area between expandable tubing of the system and a wall of the borehole, according to embodiments of the invention.

FIG. 3 illustrates introducing a fill material 300 into an annulus between the expandable tubing 102 of the system 100 and a wall of the borehole 200. The fill material 300 pumped through the work string 114 may include cement, a settable compound, foam, a compressible compound and/or compressible cement. Following introduction of the filling material 300, closing of a flow path within the cement shoe 118 may occur by rotation of the work string 114, closing a check valve, or by any other suitable mechanism.

Figure 4:
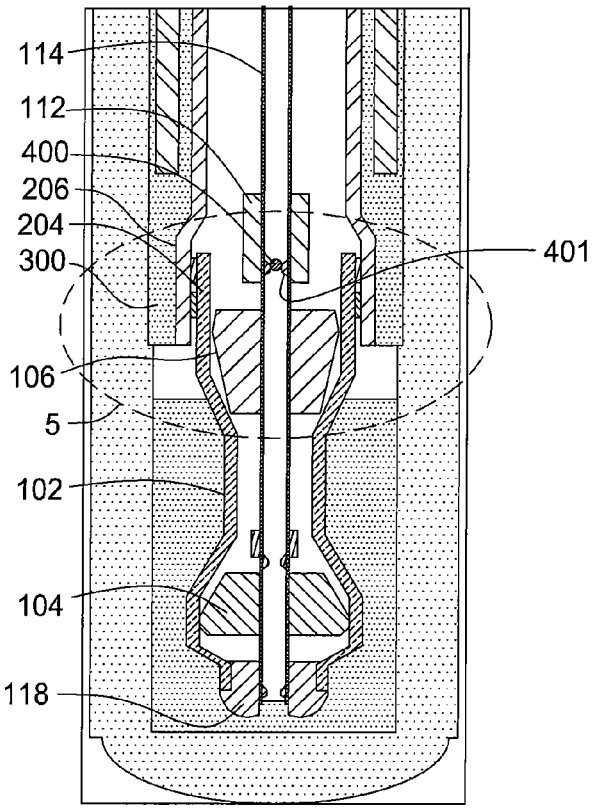
FIG. 4 shows partial expansion of existing tubing surrounding the expandable tubing via partial expansion of an overlapping section of the expandable tubing using a second expander and thereby anchoring the expandable tubing in the existing tubing, according to embodiments of the invention.

FIG. 4 shows partial expansion of the existing tubing 206 surrounding the expandable tubing 102 via partial expansion of the overlapping section 204 of the expandable tubing 102 using the second expander 106. While an exemplary sequence is illustrated, acts depicted in FIGS. 2-4 may occur in any order. In operation, the work string 114 is reclosed, for example, by actuating a valve 401, by dropping an object such as a second ball 400 or by any other suitable mechanism/device. For some embodiments, closing of the valve within the cement shoe 118 enables fluid pressure to be established in the work string 114 without dropping of the second ball 400. Pressurization of the work string 114 operates the actuation mechanism 112, which may be, for example, a jack operatively coupled to the second expander 106. The second expander 106 receives force from the actuation mechanism 112 causing the second expander 106 to slide relative to the work string 114 and pass through the overlapping section 204 of the expandable tubing 102. Without having to expand a remainder of the expandable tubing 102, the second expander 106 partly expands the overlapping section 204 of the expandable tubing 102 where increased expansion forces are required. Compressibility of the material 300 (e.g., the same as pumped around the expandable tubing 102) surrounding the existing tubing 206 at least at the overlapping section 204 allows expansion of the existing tubing 206 that is simultaneously forced outward by the expandable tubing 102. Also, the bottom of the existing tubing 206 may incorporate a device which allows for space for the existing tubing 206 to expand, such as exemplarily described in U.S. Pat. Nos. 6,725,917 and 7,303,023, which are herein incorporated by reference.

Figure 5:
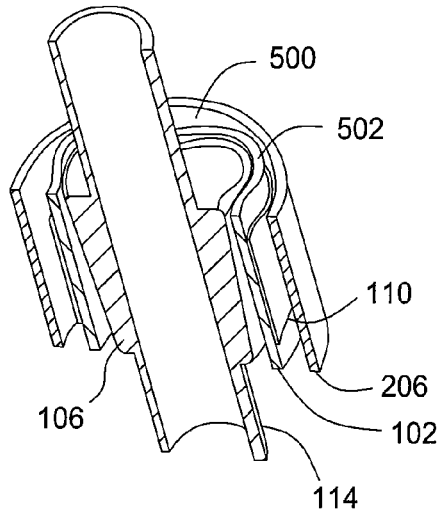
FIG. 5 illustrates a fluted shape of the second expander such that flow paths remain between the existing tubing and the expandable tubing following the partial expansion, according to embodiments of the invention.

FIG. 5 illustrates a view taken at 5 of FIG. 4 and shows a fluted shape of the second expander 106 such that flow paths 500 remain between the existing tubing 206 and the expandable tubing 102 following the partial expansion. As shown, the second expander 106 defines an outer surface with four lobed radial extensions that are larger than an inner diameter of the expandable tubing 102 prior to expansion. Any number of lobes or shapes may be appropriate. The expandable tubing 102 comes into gripping contact with the existing tubing 206 at discrete circumferentially spaced apart locations 502 corresponding to each of the lobed radial extensions of the second expander 106. The anchor 110 may include grit, teeth or carbide inserts to aid in the gripping at the locations 502. The existing tubing 206 undergoes simultaneous expansion along the circumferentially spaced apart locations 502. While expansion of the existing and expandable tubing 206, 102 remains incomplete, the partial expansion reduces force required to thereafter achieve complete circumferential expansion of the existing and expandable tubing 206, 102. Further, the flow paths 500 prevent a fluid lock by permitting fluid, in the annulus between the expandable tubing 102 and the borehole 200, displaced during subsequent expansion of the expandable tubing 102 to escape.

For some embodiments, the second expander 106 need not have a fixed fluted shape and may be disposed in the expandable tubing 102 during run-in of the expandable tubing 102. For example, the second expander 106 may include a plurality of extendable members that actuate in a radial outward direction to provide the expansion along the circumferentially spaced apart locations 502. U.S. Pat. No. 7,048,065, which is herein incorporated by reference, describes an exemplary apparatus suitable for the second expander 106 and corresponding operational details that may be employed with embodiments described herein. The second expander 106, according to some embodiments, includes an inflatable packer disposed within a cage. The cage retains parts of the packer upon inflation causing selective extrusion of the packer at the circumferentially spaced apart locations 502.

In some embodiments, the expandable tubing 102 may include one or more flow ports through a wall thereof. U.S. Pat. No. 7,152,684, which is herein incorporated by reference, provides an example of such flow ports and corresponding operational details that may be employed with embodiments described herein. When flow ports are present in the expandable tubing 102, initial expansion provided by the second expander 106 may increase in diameter an entire circumference of the expandable tubing 102 into hanging contact with the existing tubing 206 since the flow paths 500 are not necessary. The flow ports enable use of any fixed or collapsible expansion device as the second expander 106. For example, the second expander 106 in such arrangements may define a conical shape having a diameter smaller than or equal to the first expander 104 but sufficient to cause initial expansion of at least the expandable tubing 102 and optionally the existing tubing 206 even though both may be further expanded by the first expander 104. A seal below the flow ports may be expanded by the first expander 104 to seal off the ports.

Figure 6:
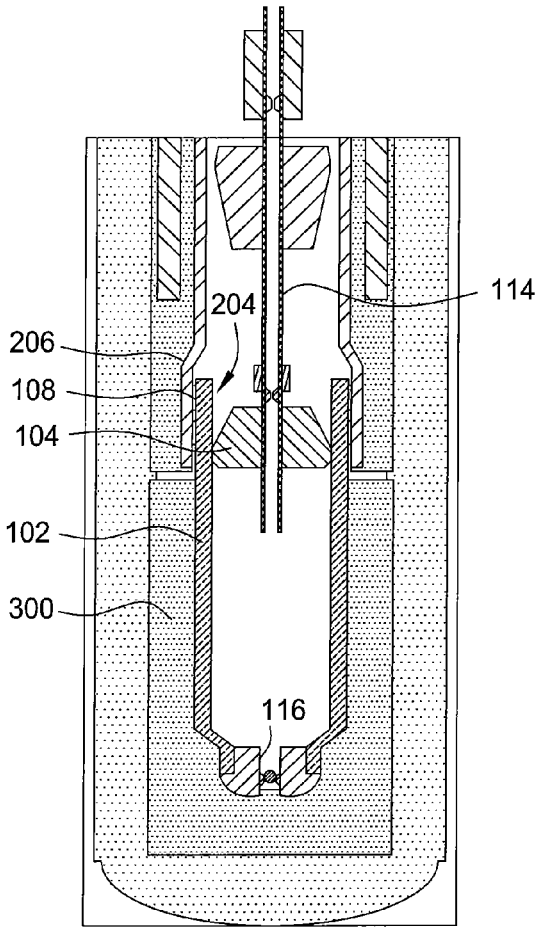
FIG. 6 shows expansion of a remainder of the expandable tubing and completing expansion of the overlapping section of the expandable tubing with the first expander, according to embodiments of the invention.

FIG. 6 shows expansion of a remainder of the expandable tubing 102 and completing expansion of the overlapping section 204 of the expandable tubing 102 with the first expander 104. The first expander 104 is released relative to the expandable tubing 102, for example, by further unthreading of the work string 114 or releasing a latch or j-slot. Fluid pressure acting the first expander 104 and/or force applied via the work string 114 may move the first expander 104. Traversing the first expander through the expandable tubing 102 increases the diameter of the expandable tubing 102. This operation thereby closes the flow paths 500 (as shown in FIG. 5) and creates a seal between the expandable and existing tubing 102, 206. If present, the sealing band 108, such as an elastomeric material, presses against respective outer and inner surfaces of the expandable and existing tubing 102, 206. Expansion with the first expander 104 may occur prior to setting of the fill material 300, which may include retardants to slow or delay setting. For some embodiments, the first expander 104 may be collapsed toward its first position to permit or facilitate retrieval of the first expander 104 without interference.

Figure 7:
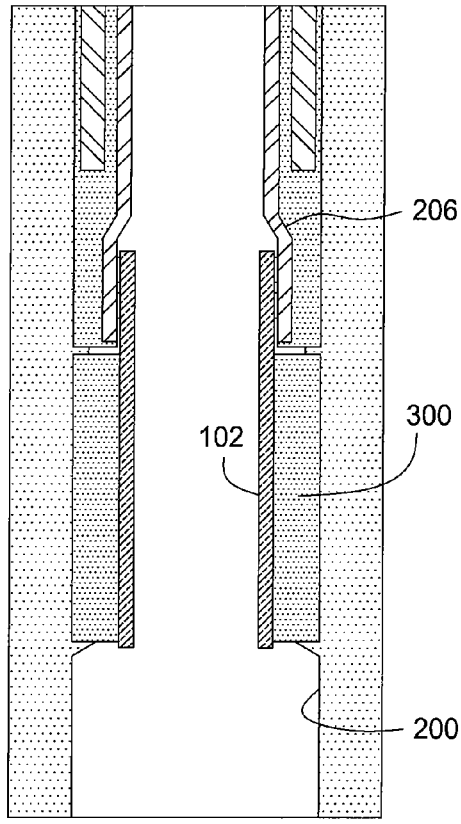
FIG. 7 illustrates the borehole upon further drilling and underreaming below the expandable tubing to enable repeating procedures shown in FIGS. 2-6 for placement of another tubing length and creation of a monobore well, according to embodiments of the invention.

FIG. 7 illustrates the borehole 200 upon further drilling and underreaming below the expandable tubing 102 to enable repeating procedures shown in FIGS. 2-6 for placement of another tubing length and creation of a monobore well. Because no oversize shoe is prepared for run-in and the expandable tubing 102 can be further expanded even after the filling material 300 is set, an operator can remedy a problem at any time and at any place along the expandable tubing 102. Without having to sidetrack, milling through the expandable tubing 102 wherever the problem is provides a basis, as shown in FIG. 7, for repeating procedures shown in FIGS. 2-6 and maintaining the monobore construction. Further, cutting a window in the expandable tubing 102 and sidetracking if a problem is encountered allows repeating procedures shown in FIGS. 2-6 where sidetracked.

Figures 8, 9, 10, 11, 12, 13:
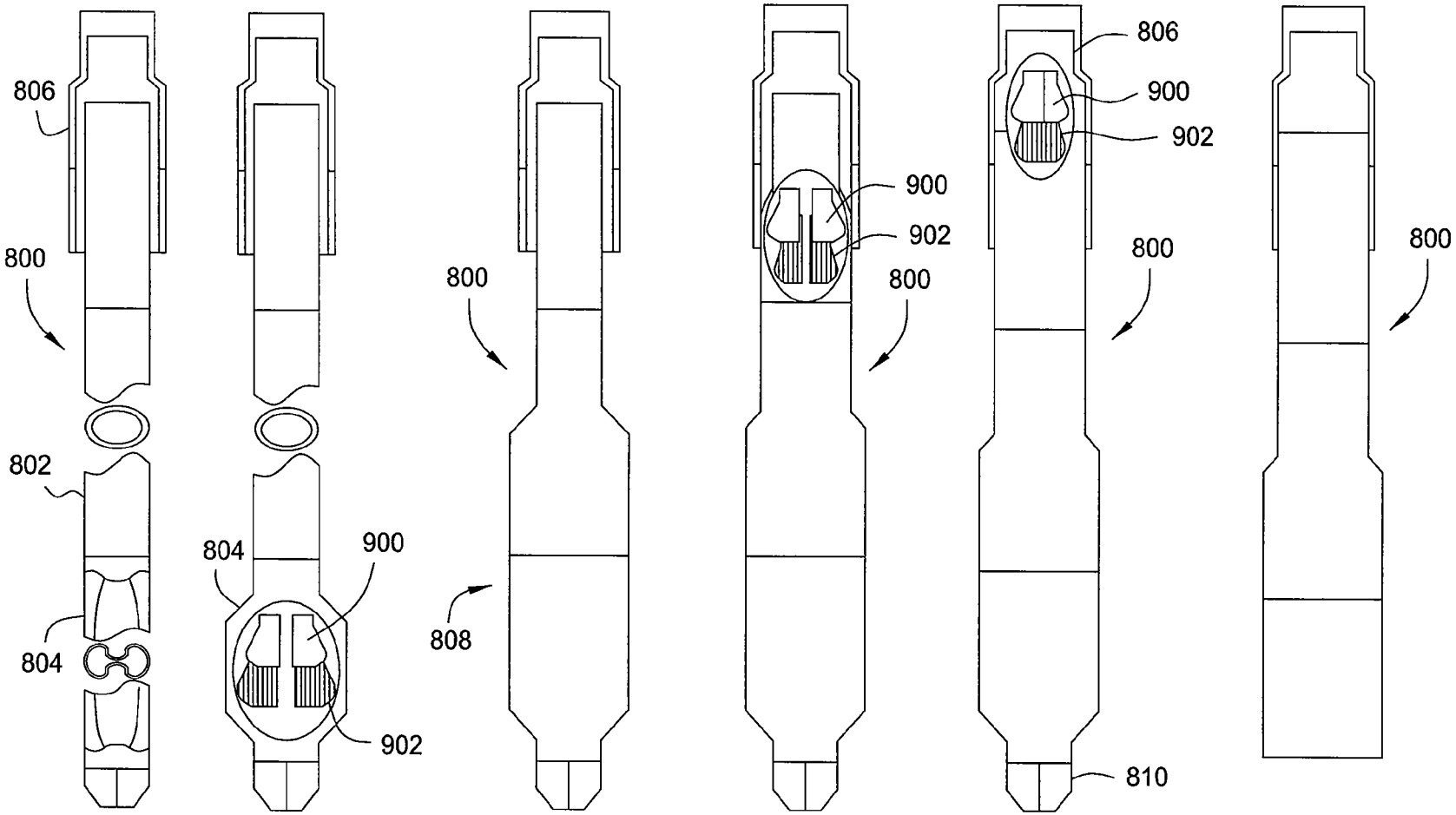
FIGS. 8-13 show a sequence of installing tubing using a dual expander bottom-up operation.

FIGS. 8-13 show a sequence of installing tubing using a dual expander bottom-up operation. FIG. 8 illustrates locating of an expandable tubing 800 in an enlarged diameter end of existing tubing 806. A garage portion 804 of the expandable tubing 800 defines a non-circular or profiled cross-section while a remainder portion 802 of the expandable tubing 800 has a circular cross section. For example, U.S. Pat. No. 7,121,351, which is herein incorporated by reference, describes a similar apparatus with a single expander instead of two expanders that are each analogous to this single expander. FIG. 9 shows, in a cut away view, schematic first and second expanders 900, 902 in the garage portion 804 after reconfiguration of the garage portion 804 to round out the profiles. The first and second expanders 900, 902 may be collapsible cones with the first expander 900 defining a smaller outer diameter in its largest configuration than the second expander 902 in its largest configuration.

FIG. 10 illustrates moving of the expanders 900, 902 through a length (e.g., 60 meters) of the expandable tubing 800. This operation defines an enlarged diameter end 808 for subsequent tubing receipt analogous to the existing tubing 806. Thereafter, the second expander 902 collapses and the first expander 900 continues with expansion of the expandable tubing 800, as shown in FIG. 11. Once the expandable tubing 800 is expanded into contact with the existing tubing 806 as shown in FIG. 12, the first expander 900 collapses for retrieval. FIG. 13 illustrates a nose 810 (as shown in FIG. 12) of the expandable tubing 800 drilled through to enable repeating of the procedures shown in FIGS. 8-12.

FIG. 14 illustrates a tubing string 1504 run into tubing 1400 with a partially enlarged inner diameter shoe 1402 at an end of the tubing 1400 where the tubing terminates into the borehole. The tubing string 1504 may also include a device 1502, such as a sealing band 108 and/or anchor 110 as described above in FIG. 1, to engage the tubing 1400 upon expansion of the tubing string 1504. A first inner diameter ($d_1$) of the tubing 1400 extends to a nose or drillable portion of the shoe 1402 and is relatively larger than an inner diameter of the remainder of the tubing 1400. The shoe 1402 undergoes further expansion once in the borehole and is hence referred to as "partially enlarged." By being partially enlarged, expansion forces for this further expansion may be reduced to acceptable levels.

FIG. 15 shows expanding a launcher 1506 of the tubing string 1504 positioned to overlap the enlarged inner diameter shoe 1402. FIG. 16 illustrates expanding the expandable tubing 1504 between the launcher 1506 and the enlarged inner diameter shoe 1402. FIG. 17 shows expansion of the expandable tubing 1504 into engagement with the enlarged inner diameter shoe 1402 using the device 1502 for example to sealingly engaging and/or securing the expandable tubing 1504 to the inner diameter shoe 1402. FIG. 17 also shows further expansion of the partially enlarged inner diameter shoe 1402 that may have already been cemented in place. An expansion force applied to the tubular string 1504 being hung inside the shoe 1402 causes radial expansion of the shoe 1402 to a second inner diameter ($d_2$) larger than the first inner diameter ($d_1$). This further expansion of the shoe 1402 may compress fill material and/or formation around the shoe 1402.

A method of installing expandable tubing in a borehole is provided. The method may comprise expanding a first portion of the expandable tubing into hanging contact with a surrounding tubing using a second expander; expanding a second portion of the expandable tubing using a first expander, wherein the second portion extends beyond the surrounding tubing; and further expanding the first portion of the expandable tubing with the first expander, wherein expanding the first portion also expands the surrounding tubing. In one embodiment, the second expander may define an outer surface with a fixed fluted shape. In one embodiment, the first expander may comprise a collapsible cone. In one embodiment, the surrounding tubing may be disposed in a compressible material. The method may include introducing a compressible material into an annulus between the borehole and the expandable tubing. In one embodiment, a flow path remains to a well interior from an annulus between the borehole and the expandable tubing after expanding the first portion of the expandable tubing with the second expander.

A system for installing expandable tubing in a borehole is provided. The system may comprise a fluted expander coupled to a first end of the expandable tubing; and a collapsible cone disposed inside the expandable tubing.

A method of installing tubular liners in a borehole is provided. The method may comprise running a first tubing string into the borehole, wherein the first tubing string as run into the borehole includes a first section that has a larger inner diameter than a second section; and expanding a second tubing string into contact with the first section of the first tubing string, wherein the expanding further enlarges an inner diameter of the first section of the first tubing string.

While the foregoing is directed to embodiments of the present invention, other and further embodiments of the invention may be devised without departing from the basic scope thereof, and the scope thereof is determined by the claims that follow.

What is claimed is:

1. A method of installing expandable tubing in a borehole, comprising:

lowering a expandable tubing in a borehole, wherein a first portion of the expandable tubing overlaps a portion of a surrounding tubing;

expanding the first portion of the expandable tubing into engagement with the surrounding tubing using an upper expander;

expanding a second portion of the expandable tubing using a lower expander, wherein the second portion does not overlap the surrounding tubing; and further expanding the first portion of the expandable tubing using the lower expander, wherein expanding the first portion also expands the surrounding tubing.

2. The method of claim 1, wherein the upper expander defines an outer surface with a fixed fluted shape.

3. The method of claim 1, wherein the lower expander comprises a collapsible cone.

4. The method of claim 1, wherein the surrounding tubing is disposed in a compressible material.

5. The method of claim 1, further comprising introducing a compressible material into an annulus between the borehole and the expandable tubing.

6. The method of claim 1, wherein a flow path remains to a well interior from an annulus between the borehole and the expandable tubing after expanding the first portion of the expandable tubing with the upper expander.

7. The method of claim 1, wherein the portion of the surrounding tubing has an inner diameter greater than an inner diameter of a remaining portion of the surrounding tubing.

8. The method of claim 1, wherein the second portion of the expandable tubing is expanded using the lower expander prior to expansion of the first portion using the upper expander.

9. The method of claim 1, wherein the upper expander is disposed above the expandable tubing and the lower expander is disposed within the expandable tubing prior to expansion of the expandable tubing.

10. The method of claim 9, further comprising moving the upper expander towards the lower expander to expand the first portion of the expandable tubing after expanding the second portion of the expandable tubing using the lower expander.

11. A method of installing tubular liners in a borehole, comprising:

running a first tubing string into the borehole, wherein the first tubing string as run into the borehole includes a first section that has an inner diameter greater than an inner diameter of a second section;

running a second tubing string into the borehole, wherein an upper portion of the second tubing string overlaps the first section of the first tubing string;

expanding a lower portion of the second tubing string prior to expanding the upper portion; and expanding the upper portion of the second tubing string into contact with the first section of the first tubing string, wherein the expanding further enlarges the inner diameter of the first section of the first tubing string.

12. The method of claim 11, further comprising actuating an expansion member disposed within the lower portion of the second tubing string to expand the lower portion of the second tubing string.

13. The method of claim 11, wherein the lower portion of the second tubing string has a non-circular cross section.

14. The method of claim 13, further comprising expanding the lower portion of the second tubing string using a second expander.

15. The method of claim 14, further comprising expanding the upper portion of the second tubing string using a first expander.

16. The method of claim 15, wherein the expanded lower portion of the second tubing string includes an inner diameter greater than or equal to an inner diameter of the expanded upper portion.

17. The method of claim 16, further comprising removing the first expander and the second expander from the borehole through the inner diameter of the second section of the first tubing string without substantial interference.

18. The method of claim 11, further comprising expanding the lower portion of the second tubing string using an expander.

19. The method of claim 18, further comprising expanding the upper portion of the second tubing string using the expander in an extended configuration defining an outer diameter that is less than an outer diameter of the expander when expanding the lower portion of the second tubing string.

20. The method of claim 11, wherein the lower portion of the second tubing is expanded to an inner diameter that is greater than an inner diameter of the expanded upper portion.

21. The method of claim 11, further comprising moving an upper expander towards a lower expander to expand the upper portion of the second tubing string, and then further expanding the upper portion using the lower expander.

22. The method of claim 11, further comprising expanding the lower portion of the second tubing string using a lower expander that is disposed within the second tubing string during run-in, and then expanding the upper portion of the second tubing string using an upper expander that is disposed above the second tubing string during run-in.

23. A system for installing expandable tubing in a borehole, comprising:

an expandable tubular;

a work string releasably coupled to the expandable tubular;

an expander coupled to the work string and disposed above the first end of the expandable tubular, wherein the expander is movable relative to the work string; and a collapsible cone coupled to the work string and disposed inside the expandable tubular, wherein the expander is operable to expand an upper portion of the expandable tubular prior to expansion with the collapsible cone.

24. The system of claim 23, wherein the expander is fluted and is moveable independent of the collapsible cone.

25. The system of claim 23, further comprising an actuation mechanism coupled to the work string and operable to move the expander relative to the expandable tubular.

26. The system of claim 23, wherein an end of the expandable tubular includes a cement shoe.

27. The system of claim 23, wherein the collapsible cone is operable to expand a lower portion of the expandable tubular prior to expansion of the expandable tubular with the expander.

28. The system of claim 23, wherein the collapsible cone is operable to further expand the upper portion of the expandable tubular after expansion of the expandable tubular with the expander.

29. The system of claim 23, wherein the expander is operable to expand the expandable tubular prior to expansion of the expandable tubular with the collapsible cone.

30. A system for installing expandable tubing in a borehole, comprising:

an expandable tubular;

a work string releasably coupled to a first end of the expandable tubular, wherein the first end of the expandable tubular includes a cement shoe;

an expander coupled to the work string and disposed above the first end of the expandable tubular, wherein the expander is movable relative to the work string; and a collapsible cone coupled to the work string and disposed inside the expandable tubular.

* * * * *